US007980104B1

(12) United States Patent
Huang

(10) Patent No.: US 7,980,104 B1
(45) Date of Patent: Jul. 19, 2011

(54) REKEYABLE LOCK CYLINDER

(75) Inventor: Chao-Ming Huang, Kaohsiung County (TW)

(73) Assignee: Taiwan Fu Hsing Industrial Co., Ltd., Kang-Shan Town, Kaohsiung County (TW)

( * ) Notice: Subject to any disclaimer, the term of this patent is extended or adjusted under 35 U.S.C. 154(b) by 0 days.

(21) Appl. No.: 12/782,976

(22) Filed: May 19, 2010

(51) Int. Cl.
*E05B 27/04* (2006.01)
*E05B 29/06* (2006.01)

(52) U.S. Cl. ..... 70/338; 70/340; 70/368; 70/383; 70/384; 70/492; 70/493; 70/495

(58) Field of Classification Search ..... 70/337–343, 70/368, 382–385, 492–496
See application file for complete search history.

(56) References Cited

U.S. PATENT DOCUMENTS

| | | | | |
|---|---|---|---|---|
| 6,119,495 | A * | 9/2000 | Loreti | 70/340 |
| 7,007,528 | B2 * | 3/2006 | Chong et al. | 70/492 |
| 7,448,239 | B1 * | 11/2008 | Huang et al. | 70/360 |
| 7,448,240 | B1 * | 11/2008 | Huang et al. | 70/492 |
| 7,526,935 | B2 * | 5/2009 | Huang et al. | 70/360 |
| 7,624,606 | B1 | 12/2009 | Huang et al. | |
| 7,628,048 | B2 * | 12/2009 | Huang et al. | 70/338 |
| 7,836,739 | B2 * | 11/2010 | Huang et al. | 70/360 |
| 2008/0264127 | A1 * | 10/2008 | Chiang et al. | 70/492 |

FOREIGN PATENT DOCUMENTS

JP 7197705 * 8/1995

* cited by examiner

*Primary Examiner* — Lloyd A Gall
(74) *Attorney, Agent, or Firm* — Muncy, Geissler, Olds & Lowe, PLLC

(57) ABSTRACT

A rekeyable lock cylinder comprises a cylinder body, a plug assembly disposed within the cylinder body and at least one adjusting member. The cylinder body has an inside wall, the plug assembly comprises a plug body having a plurality of pin holes and an opening, a plurality of assembled pins disposed within the pin holes of the plug body and a position block disposed in the plug body. Each of the assembled pins comprises a first rack component having an aligning cavity and a second rack component engaged with the first rack component. The position block has a plurality of pin runners served for disposing the first rack components and a tool-receiving hole corresponding to the opening. The adjusting member is movably disposed within one of the pin holes of the plug body and contacts against at least one first rack component and the inside wall of the cylinder body thereby forming a position difference between the tool-receiving hole and the aligning cavity.

6 Claims, 6 Drawing Sheets

REKEYABLE LOCK CYLINDER

FIELD OF THE INVENTION

The present invention is generally relating to a lock cylinder structure, more particularly to a rekeyable lock cylinder with key management capability.

BACKGROUND OF THE INVENTION

U.S. Pat. No. 7,624,606 disclosed "rekeyable lock cylinder, plug assembly of the same and method for rekeying the same" is considered relevant to the present invention disclosing a rekeying process that is to replace a new valid key by an old one. However, this might cause inconvenience in rekeying and key management with regard to hotel having numerous rooms, new building or rental mansion. In general, hotel owner only needs to provide lodger a key for opening the lock, but if the lock cylinder of room lock is rekeyable, lodger can execute rekeying process to replace a new valid key by an old one personally, which results in inconvenience of key management. Therefore, hotel owner anticipates the valid key that lodger possesses has ability to open the lock without rekeying capability. The rekeying process is executed only by hotel owner.

Accordingly, it will be obvious to those skilled in the art that the present invention is to develop a rekeyable lock cylinder that makes valid keys match with each of the rekeyable lock cylinders separately have ability to open the lock only without rekeying capability and each of the rekeyable lock cylinders matched with respective matching keys is able to execute rekeying process via a same control key only.

SUMMARY

The present invention provides a rekeyable lock cylinder comprising a cylinder body, a plug assembly disposed within the cylinder body and at least one adjusting member. The cylinder body has an inside wall, the plug assembly comprises a plug body having a plurality of pin holes and an opening, a plurality of assembled pins disposed within the pin holes of the plug body and a position block disposed at the plug body. Each of the assembled pins comprises a first rack component having an aligning cavity and a second rack component engaged with the first rack component. The position block has a plurality of pin runners served for disposing the first rack components and a tool-receiving hole corresponding to the opening. The adjusting member is movably disposed within one of the pin holes of the plug body and contacts against at least one first rack component and the inside wall of the cylinder body thereby forming a position difference between the tool-receiving hole and the aligning cavity. The primary object of the present invention is to enable the adjusting member applied to different sets of rekeyable lock cylinders having respective valid keys thereby executing rekeying process via a same control key. Besides, the adjusting member contacts against at least one first rack component and the inside wall so that a position difference is formed between the tool-receiving hole and the aligning cavity that makes a valid key match with rekeyable lock cylinder served only for opening the lock without rekeying capability.

DETAILED DESCRIPTION OF THE INVENTION

Figure 1:
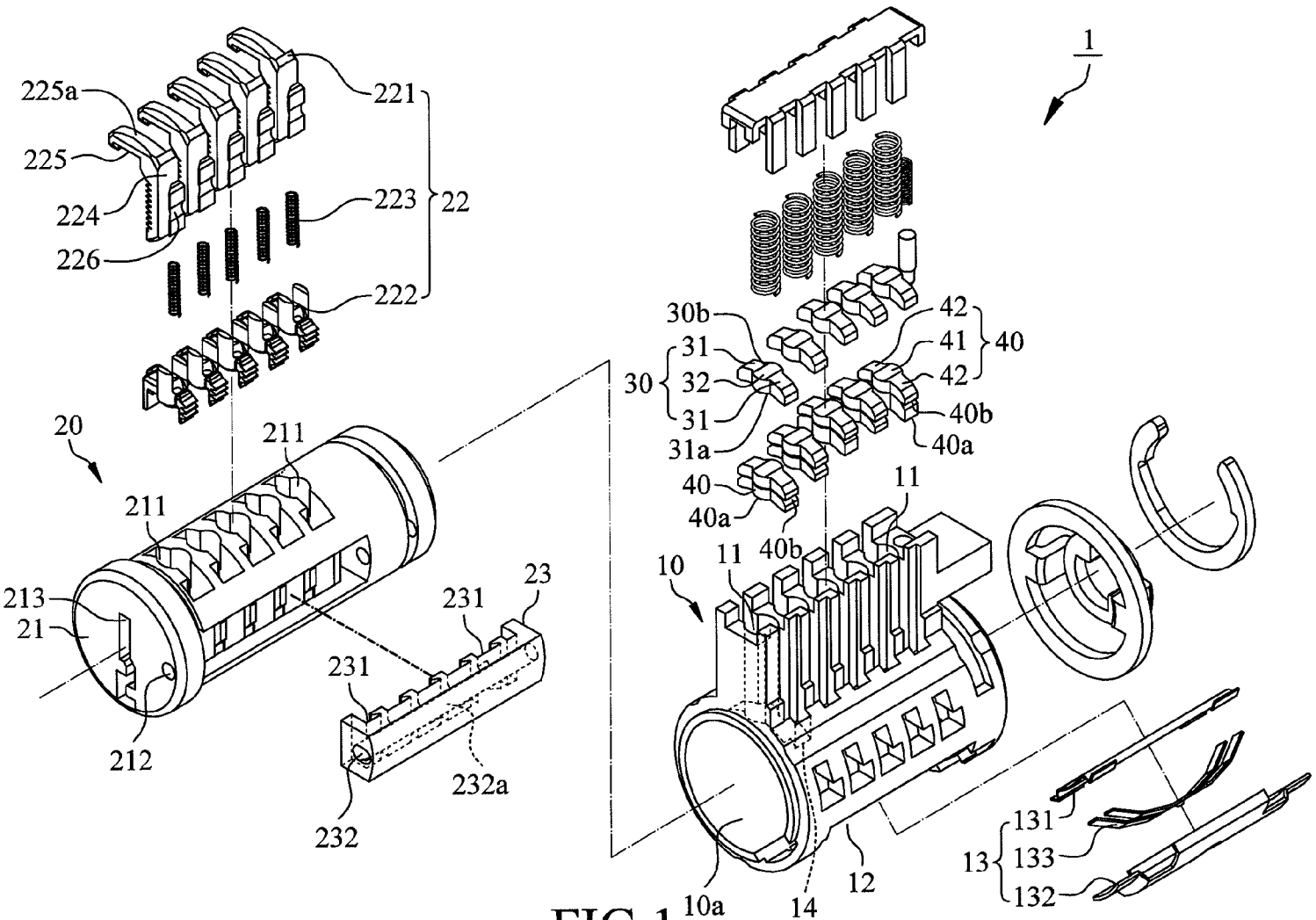
FIG. 1 is a perspective exploded view illustrating a rekeyable lock cylinder in accordance with a preferred embodiment of the present invention.
Figure 2:
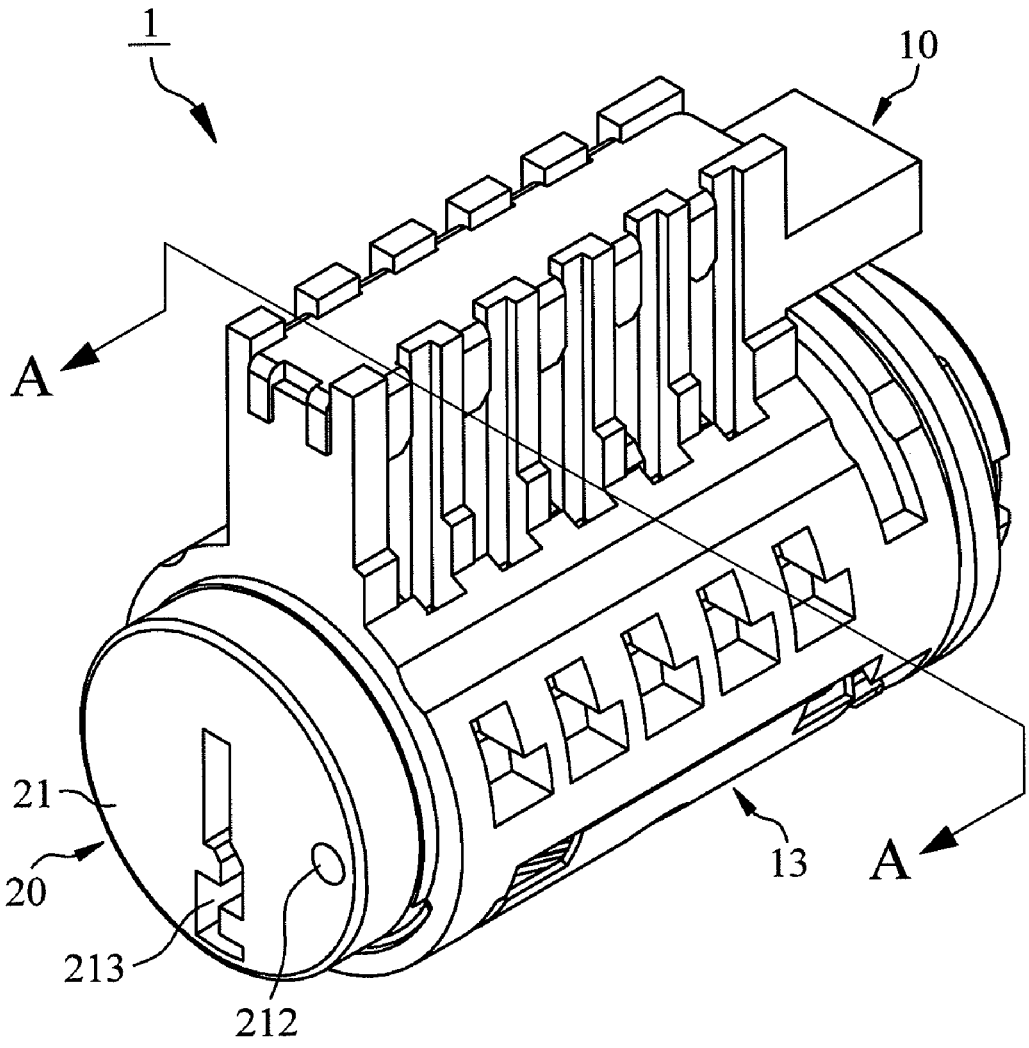
FIG. 2 is a perspective assembly view illustrating the rekeyable lock cylinder.
Figure 3:
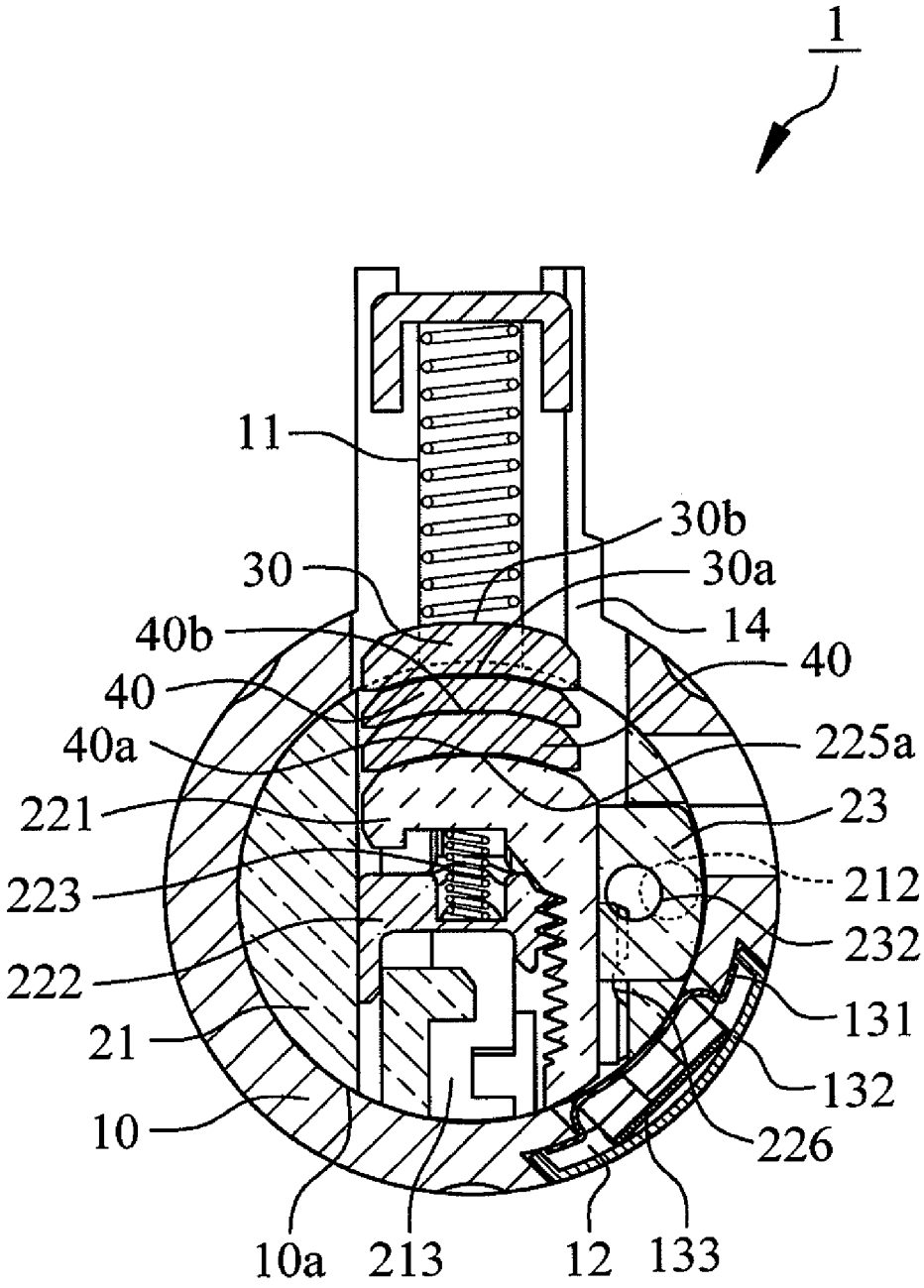
FIG. 3 is an assembled section view illustrating the rekeyable lock cylinder along A-A line of FIG. 2.

With reference to FIGS. 1, 2 and 3, a rekeyable lock cylinder 1 in accordance with a preferred embodiment of the present invention comprises a cylinder body 10, a plug assembly 20 disposed within the cylinder body 10, a plurality of upper pins 30 and at least one adjusting member 40. The cylinder body 10 has an inside wall 10*a*, a plurality of upper pin holes 11, a recession 12, a resilient assembly 13 disposed at the recession 12 and a plurality of accommodating slots 14 formed at each of the upper pin holes 11. Within this embodiment, the resilient assembly 13 comprises a movable plate 131 being capable of transversely moving within the recession 12, a fixing plate 132 fixed at the recession 12 and an elastic member 133 disposed between the movable plate 131 and the fixing plate 132.

With reference to FIGS. 1 and 3, the plug assembly 20 comprises a plug body 21, a plurality of assembled pins 22 and a position block 23 disposed at the plug body 21. The plug body 21 has a plurality of pin holes 211, an opening 212 and a keyhole 213. The assembled pins 22 are height-adjustable and disposed at each of the pin holes 211 of the plug body 21 respectively. Each of the assembled pins 22 comprises a first rack component 221, a second rack component 222 engaged with the first rack component 221 and an elastic component 223 disposed between the first rack components 221 and the second rack components 222. The first rack component 221 has a rack portion 224, a push portion 225 coupled to the rack portion 224 and an aligning cavity 226 formed at the rack portion 224, wherein each of the push portions 225 has an arc-shaped top surface 225*a*.

With reference again to FIGS. 1 and 3, the position block 23 has a plurality of pin runners 231 served for disposing the first rack components 221 and a tool-receiving hole 232 corresponding to the opening 212. In this embodiment, a tool-contacting surface 232*a* is located within the tool-receiving hole 232 and faces toward the first rack components 221. The upper pins 30 are movably disposed at the upper pin holes 11 of the cylinder body 10, each of the upper pins 30 has a first curved surface 30*a*, a second curved surface 30*b* opposite to the first curved surface 30*a*, a central portion 31 and a pair of wing portions 32 formed at two sides of the central portion 31 respectively.

Figure 4:
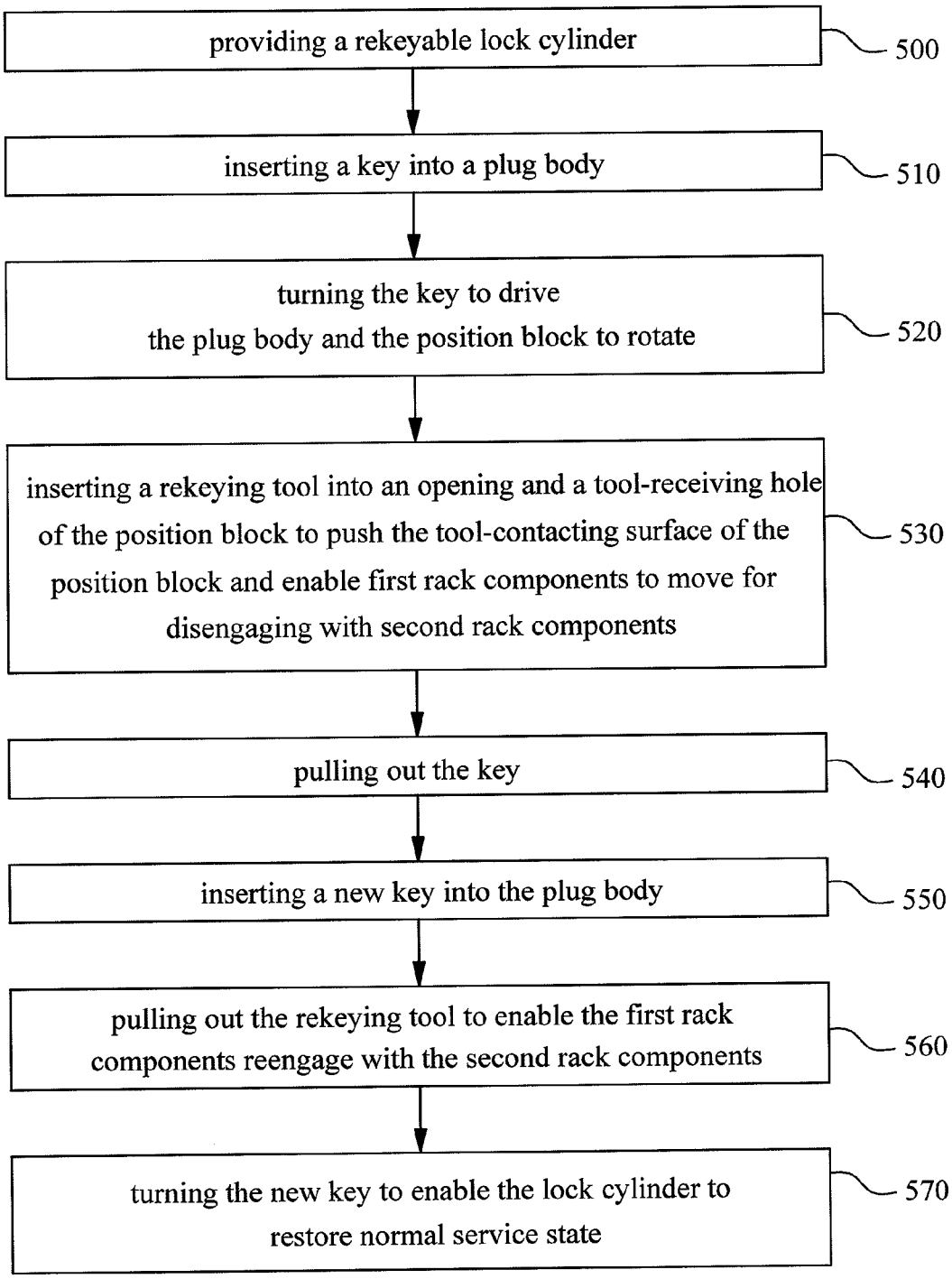
FIG. 4 is a flow chart for operating method of the rekeyable lock cylinder.

With reference again to FIGS. 1 and 3, the adjusting member 40 is movably disposed within one of the pin holes 211 of the plug body 21 and this embodiment utilizes a plurality of the adjusting members 40, wherein each of the adjusting members 40 is movably disposed within each of the pin holes 211 of the plug body 21 respectively. Each of the adjusting members 40 contacts against and is located between each of the upper pins 30 and each of the first rack components 221 separately. Besides, each of the adjusting members 40 has a first arc surface 40*a*, a second arc surface 40*b* opposite to the first arc surface 40*a*, a central portion 41 and a pair of wing portions 42 formed at two sides of the central portion 41 respectively. The central portion 41 and the wing portion 42 contact against the first rack component 221. In this embodiment, each of the adjusting members 40 contacts against the push portion 225 of each of the first rack components 221 and each of the upper pins 30, the first arc surface 40*a* of each of the adjusting member 40 contacts against the arc-shaped top surface 225*a* of each of the push portions 225, and the second arc surface 40*b* of each of the adjusting members 40 contacts against the first curved surface 30*a* of each of the upper pins 30. It is preferable that curvatures of the first arc surface 40*a* of each of the adjusting members 40 and the arc-shaped top surface 225*a* of each of the push portions 225 are the same and curvatures of the second arc surface 40*b* of each of the adjusting members 40 and the first curved surface 30*a* of each of the upper pins are the same, which may prevent the rekeyable lock cylinder 1 from inaction due to inclination of the adjusting member 40 when the plug body 21 turns. FIG. 4 illustrates rekeying method of the rekeyable lock cylinder 1 comprising "providing a rekeyable lock cylinder" step 500, "inserting a key into a plug body" step 510, "turning the key to drive the plug body and the position block to rotate" step 520, "inserting a rekeying tool into an opening and a tool-receiving hole of the position block to push the tool-contacting surface of the position block and enable first rack components to move for disengaging with second rack components" step 530, "pulling out the key" step 540, "inserting a new key into the plug body" step 550, "pulling out the rekeying tool to enable the first rack components reengage with the second rack components" 560 and "turning the new key to enable the lock cylinder to restore normal service state" step 570.

It will be described as follows that a valid key can be used only for opening the lock without rekeying capability via the rekeyable lock cylinder 1.

Figure 5:
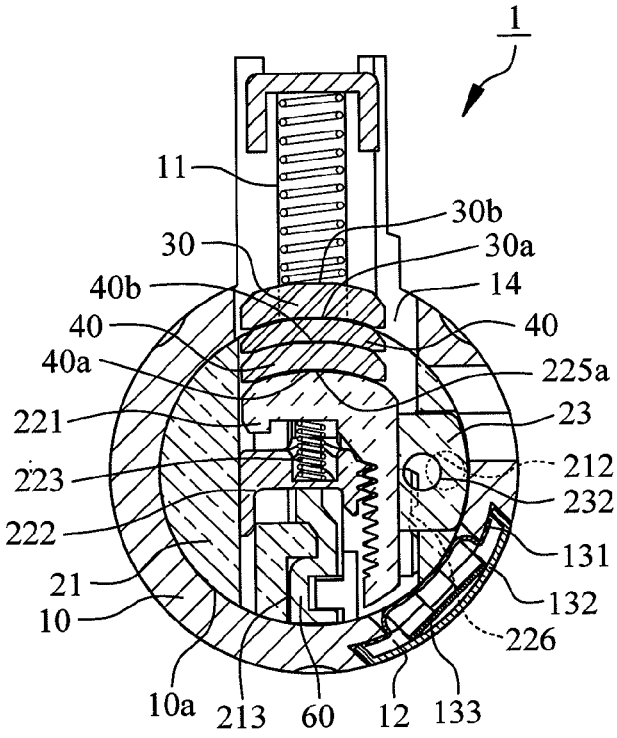
FIG. 5 is a section view illustrating a valid key is inserted into the rekeyable lock cylinder in accordance with a preferred embodiment of the present invention.
Figure 6:
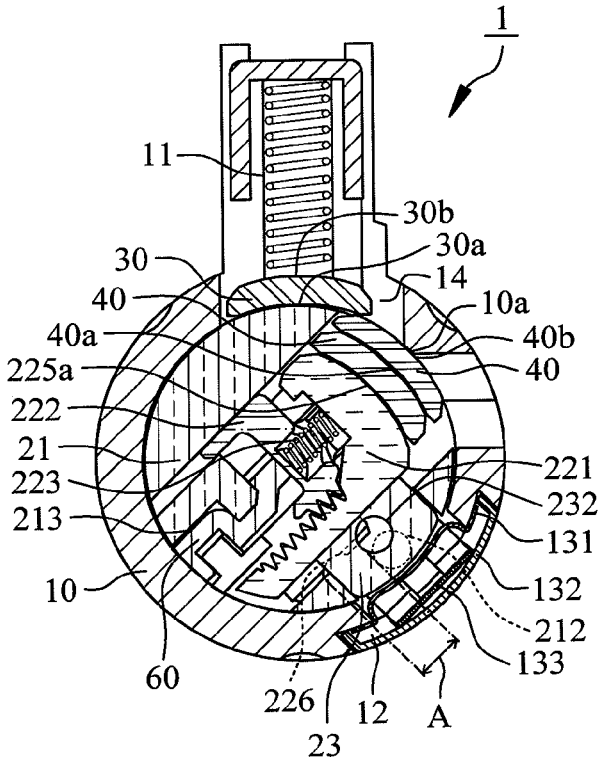
FIG. 6 is a section view illustrating the valid key is turned 45-degrees clockwise in accordance with a preferred embodiment of the present invention.

Initially, with reference to FIGS. 1, 3 and 4, the rekeyable lock cylinder 1 is composed of the cylinder body 10, the plug assembly 20, the upper pins 30 and the adjusting members 40 during "providing a rekeyable lock cylinder" step 500, wherein the tool-receiving hole 232 of the position block 23 corresponds to the opening 212 of the plug body 21, the first rack components 221 are engaged with the second rack components 222 in this embodiment. Next, with reference to FIGS. 4 and 5, a valid key 60 is inserted into the keyhole 213 of the plug body 21 and pushes the assembled pins 22 and the adjusting members 40 to move upwardly during "inserting a key into a plug body" step 510, wherein when the valid key 60 is inserted into the keyhole 213 of the plug body 21, the adjusting members 40 are located within each of the pin holes 211 of the plug body 21, and the valid key 60 merely pushes the adjusting members 40 to a rotating interface. Next, with reference to FIGS. 4 and 6, the valid key 60 is turned to drive the plug body 21 and the position block 23 to rotate to a predetermined angular position within the cylinder body 10 and each of the assembled pins 22 and each of the adjusting members 40 disposed within each of the pin holes 211 are simultaneously driven by the plug body 21 during "turning the key to drive the plug body and the position block to rotate" step 520, wherein the adjusting members 40 rotate along the inside wall 10*a*. With reference to FIG. 6, after the plug body 21 and the position block 23 are driven by the valid key 60 to rotate to the predetermined angular position, the position block 23 corresponds to the resilient assembly 13 and contacts against the movable plate 131 of the resilient assembly 13, and the first rack component 221 is limited between the first arc surface 40*a* of each of the adjusting members 40 and the inside wall 10*a* of the cylinder body 10. In addition, the first arc surface 40*a* of each of the adjusting members 40 contacts against the arc-shaped top surface 225*a* of each of the push portions 225 separately and the second arc surface 40*b* of each of the adjusting members 40 contacts against the inside wall 10*a* of the cylinder body 10 so that a position difference A is formed between the tool-receiving hole 232 of the position block 23 and the aligning cavity 226 of each of the first rack components 221 thereby enabling the rekeying tool (not shown in the drawing) cannot be inserted into the tool-receiving hole 232 of the position block 23 through the opening 212 of the plug body 21 so as to be unable to push the position block 23 thereby disengaging the first rack components 221 and the second rack components 222 to cause incapacity of proceeding subsequent rekeying steps of 530, 540, 550, 560 and 570. Accordingly, when the valid key 60 is inserted into the keyhole 213 of the plug body 21 and being rotated, the adjusting members 40 merely form the position difference A between the tool-receiving hole 232 and each of the aligning cavities 226 instead of limiting the plug body 21 and the position block 23 to rotate within the cylinder body 10, so the valid key 60 is capable of opening the lock without rekeying capability.

Furthermore, it will be described as follows that a control key is used for executing rekeying process via the rekeyable lock cylinder 1 mentioned above.

Figure 7:
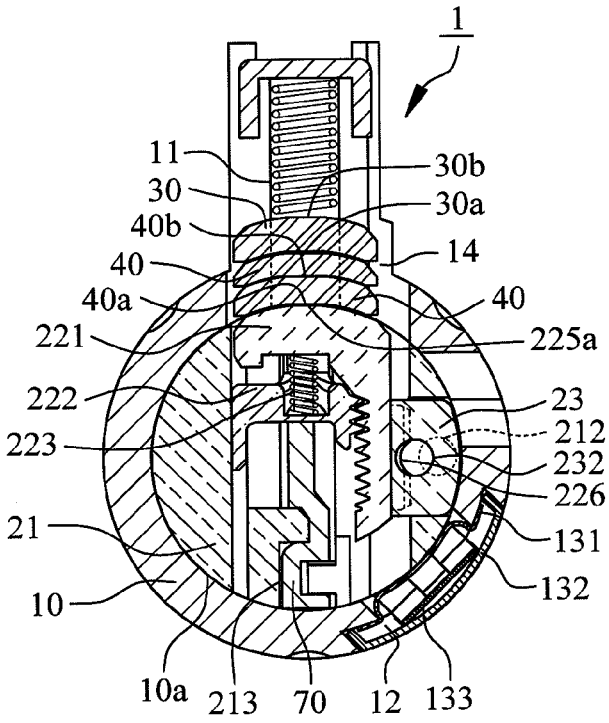
FIG. 7 is a section view illustrating a control key is inserted into the rekeyable lock cylinder in accordance with a preferred embodiment of the present invention.
Figure 8:
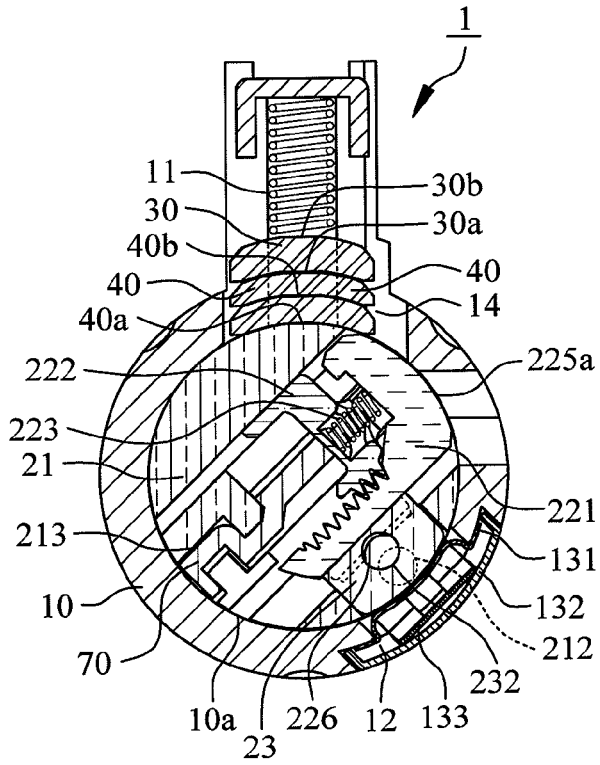
FIG. 8 is a section view illustrating the control key is turned 45-degrees clockwise in accordance with a preferred embodiment of the present invention.

Initially, with reference to FIGS. 1, 3 and 4, the rekeyable lock cylinder 1 is composed of the cylinder body 10, the plug assembly 20, the upper pins 30 and the adjusting members 40 during "providing a rekeyable lock cylinder" step 500, wherein the tool-receiving hole 232 of the position block 23 corresponds to the opening 212 of the plug body 21, the first rack components 221 are engaged with the second rack components 222 in this embodiment. Next, with reference to FIGS. 4 and 7, a control key 70 is inserted into the keyhole 213 of the plug body 21 and pushes the assembled pins 22 and the adjusting members 40 to move upwardly during "inserting a key into a plug body" step 510, wherein when the control key 70 is inserted into the keyhole 213 of the plug body 21, the adjusting members 40 are located within the pin hole 211 of each of the accommodating slots 14, and the control key 70 pushes each of the first rack components 221 of the assembled pins 22 to the rotating interface. Next, with reference to FIGS. 4 and 8, the control key 70 is turned to drive the plug body 21 and the position block 23 to rotate to a predetermined angular position within the cylinder body 10 during "turning the key to drive the plug body and the position block to rotate" step 520, wherein the adjusting members 40 being remained within the accommodating slots 14 of the cylinder body 10. Therefore, after turning the plug body 21 and the position block 23 to the predetermined angular position, there is no position difference between the tool-receiving hole 232 of the position block 23 and the aligning cavity 226 of each of the first rack components 221 so that the rekeying tool (not shown in the drawing) can be inserted into the tool-receiving hole 232 of the position block 23 to proceed subsequent rekeying steps of 530, 540, 550, 560 and 570.

The present invention is to enable the adjusting members 40 applied to different sets of rekeyable lock cylinders 1 having respective valid keys thereby executing rekeying process via a same control key. Besides, the adjusting members 40 contact against at least one first rack component 221 and the inside wall 10*a* so that a position difference A is formed between the tool-receiving hole 232 and the aligning cavity 226 that makes the valid key 60 match with the rekeyable lock cylinder 1 served only for opening the lock without rekeying capability.

While this invention has been particularly illustrated and described in detail with respect to the preferred embodiments thereof, it will be clearly understood by those skilled in the art that it is not limited to the specific features shown and described and various modifications and changes in form and details may be made without departing from the spirit and scope of this invention.

What is claimed is:

1. A rekeyable lock cylinder comprising:

a cylinder body having an inside wall;

a plug assembly disposed within the cylinder body, comprising:

a plug body having a plurality of pin holes and an opening;

a plurality of assembled pins disposed within each of the plurality of pin holes of the plug body respectively, wherein each of the plurality of assembled pins comprises a first rack component and a second rack component engaged with the first rack component, each of the plurality of first rack components having an aligning cavity; and a position block disposed at the plug body and having a plurality of pin runners served for disposing the plurality of first rack components and a tool-receiving hole corresponding to the opening; and at least one adjusting member movably disposed within one of the plurality of pin holes of the plug body and contacting against the first rack component and the inside wall of the cylinder body, thereby forming a position difference between the tool-receiving hole of the position block and the aligning cavities of the plurality of first rack components.

2. The rekeyable lock cylinder in accordance with claim 1, wherein the at least one adjusting member has a central portion and a pair of wing portions formed at two sides of the central portion respectively, the central portion contacts against the first rack component.

3. The rekeyable lock cylinder in accordance with claim 2, wherein each of the wing portions of the at least one adjusting member contacts against the first rack component.

4. The rekeyable lock cylinder in accordance with claim 1, wherein each of the plurality of first rack components has a rack portion and a push portion coupled to the rack portion, the at least one adjusting member contacts against the push portion of the first rack component.

5. The rekeyable lock cylinder in accordance with claim 4, wherein the push portion of the first rack component has an arc-shaped top surface, the at least one adjusting member has a first arc surface contacted against the arc-shaped top surface and a second arc surface opposite to the first arc surface, wherein curvatures of the first arc surface and the arc-shaped top surface are the same.

6. The rekeyable lock cylinder in accordance with claim 5, further comprising a plurality of upper pins, each of the upper pins has a first curved surface, wherein curvatures of the second arc surface of each of the at least one adjusting members and the first curved surface of each of the upper pins are the same.

* * * * *